United States Patent [19]

Chang et al.

[11] Patent Number: 4,754,096

[45] Date of Patent: Jun. 28, 1988

[54] PRODUCTION OF HIGH VISCOSITY INDEX LUBRICATING OILS FROM LOWER OLEFINS

[75] Inventors: Clarence D. Chang, Princeton; John D. Dixon, Trenton, both of N.J.; Albert B. Schwartz, Philadelphia, Pa.; David S. Shihabi, Pennington, N.J.

[73] Assignee: Mobil Oil Corporation, New York, N.Y.

[21] Appl. No.: 72,319

[22] Filed: Jul. 13, 1987

[51] Int. Cl.[4] ..... C07C 2/02; C07C 2/04

[52] U.S. Cl. ..... 585/533; 585/12; 585/415

[58] Field of Search ..... 585/533, 415, 12

[56] References Cited

U.S. PATENT DOCUMENTS

| | | | |
|---|---|---|---|
| 3,992,466 | 11/1976 | Plank et al. | 585/533 |
| 4,149,960 | 4/1979 | Garwood et al. | 208/111 |
| 4,150,062 | 4/1979 | Garwood et al. | 585/415 |
| 4,377,469 | 3/1983 | Shihabi | 208/111 |
| 4,499,325 | 2/1985 | Klotz et al. | 585/671 |
| 4,517,399 | 5/1985 | Chester et al. | 585/533 |
| 4,520,215 | 5/1985 | Owen et al. | 585/255 |
| 4,520,221 | 5/1985 | Chen | 585/533 |
| 4,524,232 | 6/1985 | Chester et al. | 585/533 |
| 4,547,609 | 10/1985 | Dessau | 585/533 |
| 4,547,613 | 10/1985 | Garwood et al. | 585/533 |
| 4,568,786 | 2/1986 | Chen et al. | 585/517 |
| 4,665,265 | 5/1987 | Chu et al. | 585/533 |

FOREIGN PATENT DOCUMENTS 1153974 9/1983 Canada .

*Primary Examiner*—Asok Pal

*Attorney, Agent, or Firm*—Alexander J. McKillop; Michael G. Gilman; L. G. Wise

[57] ABSTRACT

A process for the production of lubricant oil range hydrocarbon having increased viscosity index by oligomerization of lower olefins over medium pore shape selective acid zeolite catalyst. The preferred oligomerization process is conducted using 50 ppm to 5 weight percent of water vapor as cofeed, based on olefin and acid ZSM-5 zeolite.

7 Claims, No Drawings

PRODUCTION OF HIGH VISCOSITY INDEX LUBRICATING OILS FROM LOWER OLEFINS

FIELD OF THE INVENTION

This invention relates to a process for the production of a high viscosity index lubricating oil fraction using a fixed bed catalyst reactor with zeolite type catalyst. More particularly, this invention relates to a process for the manufacture of synthetic high viscosity index lubricating oil by the oligomerization of lower olefins over ZSM-5 zeolite catalyst by cofeeding small amounts of water with the hydrocarbon stream.

BACKGROUND OF THE INVENTION

The conversion of olefins over ZSM-5 type catalyst is known in the art and is the subject of many patents. A wide range of techniques have been disclosed leading to the improved production of gasoline, distillates and lubricant range hydrocarbons through catalyst modifications, unique process conditions and the like. For example, U.S. Pat. No. 4,227,992 and the patents therein are excellent examples of the prior art in connection with this general subject.

In U.S. Pat. No. 4,517,399 to Chester, olefins are oligomerized over ZSM-5 type zeolite catalyst to obtain high viscosity index lubricating oils wherein the improvement involves the use of large crystal size ZSM-5.

In U.S. Pat. No. 4,547,613 to Garwood et al., light olefins are converted into a high viscosity index lubricating oil by contacting at elevated pressure with ZSM-5 type catalyst that has been conditioned by treatment with a light hydrocarbon gas at low pressure and elevated temperature.

In U.S. Pat. No. 4,520,221 to Chen, a process is disclosed providing high yields of lubricating oils with substantially higher viscosity indices from the conversion of light olefins such as propylene using ZSM-5 catalyst. The results are achieved by removing the surface acidity of the catalyst by treatment with a bulky amine. U.S. Pat. No. 4,568,786 to Chen et al. discloses a continuous process for the conversion of olefins to heavier hydrocarbons containing a lubricant fraction of high viscosity index by cofeeding a surface deactivating agent such as a bulky amine. In the U.S. Pat. No. 4,150,062 to Garwood et al., an olefins conversion process is described to produce high octane gasoline using aluminosilicate zeolite catalyst, including ZSM-5. Large molar equivalents of water, preferably about 0.5 to about 5 moles of water per mole of olefin feedstock, are cofed with olefin in the process.

It is an object of the present invention to provide an improved process for upgrading olefins to lubricant oils of high viscosity index. In particular, it is an object of the present invention to provide a process for the upgrading of olefins to lubricant oils using medium pore shape selective aluminosilicate zeolite type catalysts without the use of costly organic surface deactivating agents or complex process conditions.

SUMMARY OF THE INVENTION

In the present invention a process is provided for the polymerization of $C_2$–$C_6$ olefins into high viscosity index lubricating oils in a reaction zone maintained under conditions such that polymerization is accomplished in the temperature range of about 150° to 400° C. (300°–750° F.) with water vapor provided as cofeed with the olefins at 50 parts per million to 5% based upon the feed. The polymerization is conducted in the presence of a catalyst comprising a crystalline metallosilicate zeolite characterized by Bronsted acid active sites and having a constraint index, within the approximate range of 1–12.

More particularly, the invention provides a process for the production of high viscosity index lubricating oils comprising, contacting at least one lower olefin with metallosilicate solid catalyst having the crystalline structure of ZSM-5 under oligomerizing conditions at elevated temperature and pressure in the presence of water to produce a mixture comprising oligomerized olefins, said water being present in sufficient amount to increase the viscosity index of lubricant range hydrocarbons; separating a lubricant range hydrocarbon fraction of high viscosity index from said oligomerized lower olefins mixture.

DESCRIPTION OF SPECIFIC EMBODIMENTS

Recent developments in zeolite technology have provided a group of medium pore siliceous materials having similar pore geometry. Most prominent among these intermediate pore size zeolites is ZSM-5, which is usually synthesized with Bronsted acid active sites by incorporating a tetrahedrally coordinated metal, such as Al, Ga, or Fe, within the zeolitic framework. These medium pore zeolites are favored for acid catalysis; however, the advantages of ZSM-5 structures may be utilized by employing highly siliceous materials or cystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

The shape-selective medium pore oligomerization/-polymerization catalysts preferred for use herein include the crystalline aluminosilicate zeolites having a silica to alumina molar ratio of at least 12, a constraint index of about 1 to 12 and acid cracking activity of about 50–300. Representative of the ZSM-5 type zeolites are ZMS-5, ZSM-11, ZSM-12, ZSM-23, ZSM-35, ZSM-38, and ZSM-48. ZSM-5 is disclosed and claimed in U.S. Pat. No. 3,702,886 and U.S. Pat. No. Re. 29,948; ZSM-11 is disclosed and claimed in U.S. Pat. No. 3,709,979. Also, see U.S. Pat. Nos. 3,832,449 for ZSM-12; 4,076,842 for ZSM-23; 4,016,245 for ZSM-35 4,046,839 for ZSM-38, and 4,585,747 for ZSM-48. The disclosures of these patents are incorporated herein by reference. A suitable shape selective medium pore catalyst for fixed bed is a small crystal H-ZSM-5 zeolite (silica:alumina ratio=70:1) with alumina binder in the form of cylindrical extrudates of about 1–5 mm. Unless otherwise stated in this description, the catalyst shall consist essentially of ZSM-5, which has a crystallite size of about 0.02 to 0.05 micron.

Shape-selective oligomerization, as it applies to the conversion of $C_2$–$C_6$ olefins over ZSM-5, is known to produce higher olefins up to $C_{30}$ and higher. As reported by Garwood in Intrazeolite Chemistry 23, (Amer. Chem. Soc., 1983), reaction conditions favoring higher molecular weight product are low temperature, elevated pressure, and long contact time. The reaction under these conditions proceeds through the acid-catalyzed steps of (1) oligomerization, (2) isomerization-cracking to a mixture of intermediate carbon number olefins, and (3) interpolymerization to give a continuous boiling product containing all carbon numbers. The channel systems of ZSM-5 type catalysts impose shape-selective constraints on the configuration of the large molecules, accounting for the differences with other catalysts.

An important characteristic of the crystal structure of the zeolites for use herein is that they provide constrained access to, and egress from, the intracrystalline free space by virtue of having a pore dimension greater than about 5 angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type catalysts useful in this invention possess, in combination: a silica to alumina ratio of at least about 12; and a structure providing constrained access to the crystalline free space.

The silica to alumina ratio referred to may be determined by conventional analysis. This ratio is meant to represent, as closely as possible, the ratio in the rigid anoinic framework of the zeolite crystal and to exclude aluminum in the binder or in cationic or other form within the channels. Although catalysts with a silica to alumina ratio of at least 12 are useful, it is preferred to use catalysts having higher ratios of about 20:1 to 200:1 preferably about 30–70:1.

Catalysts suitable for the present invention are those having a constraint index in the approximate range of 1 to 12, as determined by the test procedure of U.S. Pat. No. 4,016,218, incorporated herein by reference.

In the process according to this invention $C_2$ to $C_6$ olefinic hydrocarbons, such as propylene, are polymerized to produce an oligomerized liquid mixture from which is separated a fraction boiling above 343° C. (650° F.) which comprises a lubricating oil fraction with a high viscosity index. Typically, the polymerization is conducted between 150° C. to 400° C. (300° to 750° F.), but preferably at about 460° F. The polymerization pressure may range between 200 psig (1500 kPa) to 3000 psi (20,000 kPa), but preferably the polymerization is conducted at a pressure of at least about 2,750 kPa. Liquid hourly space velocities for the polymerization can be from about 0.1 to 10, but preferably 0.5 to 1.

In the preparation of high viscosity lubricant oils through the practice of the process of the instant invention, cofeeding of water vapor or a water precursor such as methanol and lower aliphatic oxygenated hydrocarbon, together with the olefinic feedstock material is advantageous. It has been discovered that the benefits described herein are achieved when water vapor is cofed in small amounts continuously or intermittently. These amounts of cofed water can range from 50 parts per million to 5 wt.% based on the weight of olefinic feed material. Preferably, very small amounts of cofed water vapor, about 0.6 weight percent are employed to produce a $C_{20}$–$C_{60}$ hydrocarbon lube oil fraction with a high viscosity index.

The viscosity index of a hydrocarbon lubricant oil fraction is related to its molecular conformation. Extensive branching in a molecule usually results in a low viscosity index. It is believed that two modes of oligomerization/polymerization of olefins can take place over acidic zeolites such as HZSM-5. One reaction sequence takes place at Bronsted acid sites inside the channels or pores, producing essentially linear material. The other reaction sequence occurs on the outer surface, producing highly branched material. By decreasing the surface acid activity of such zeolites, fewer highly branched products with low viscosity index are obtained.

Several techniques may be used to increase the relative ratio of intracrystalline acid sites to surface active sites. This ratio increases with crystal size due to geometric relationships between volume and superfical surface area, deposition of carbonaceous materials by coke formation and by surface chemisorption of organic bases. Without wishing to be restricted by theoretical considerations, it is believed that cofeeding of a small amount of water in the ZSM-5 acid-catalyzed oligomerization of olefins enhances the intracrystalline acid site polymerization in preference to surface active site polymerization leading preferentially to the formation of more linear lubricant range hydrocarbons with an attendant enhancement in viscosity index. Co-feeding small amounts of water represents an advantageous method to produce high viscosity index lubes from olefins in that water is inexpensive, easy to handle and can be easily separated from the liquid product.

In a preferred mode of the instant invention the raw product is stabilized to provide a high viscosity lubricant by hydrogenation using conventional hydrogenation catalysts, such as nickel-molybdenum, and hydrogen.

The following examples serve to illustrate the practices and advantages of the present invention. In the examples VI is viscosity index and WHSV is weight hourly space velocity of propylene.

EXAMPLE 1

Fifteen parts of weight of a standard 70/1$SiO_2$/$Al_2O_3$ ZSM-5 extrudate catalyst are mixed with 22 parts by weight purified sand, placed in a closed pressure vessel reactor as a fixed bed and a charge of propylene is continuously fed at a rate of 0.75–1.22 WHSV under substantially isothermal conditions in the presence and absence of water cofeed. A summary of these experiments is shown in Table I.

TABLE I

Propylene Polymerization in Example 1

| Run No. | 14 | 16 | 20 | A | B | C |
|---|---|---|---|---|---|---|
| Time on Steam, Days | 21 | 22 | 28 | 45 | 65 | 95 |
| Temperature, | | | | | | |
| (°F.) | (442) | (444) | (444) | (444) | (469) | (469) |
| °C. | 228 | 229 | 229 | 229 | 243 | 243 |
| Wt. % $H_2O$ | 0 | 0 | 0 | 1.9 | .46 | 0 |
| Pressure, kpa (psig) | (400) | (400) | (400) | (400) | (1000) | (1000) |
| | 2760 | 2760 | 2760 | 2760 | 6900 | 6900 |
| WHSV | .75 | 1.0 | 1.22 | .75 | .75 | .75 |
| % 650° F.+ in Liquid | 21 | 18 | 15 | 6 | 12 | 15 |
| Initial Boiling Point of Lube Isolated, | | | | | | |
| (°F.) | (650) | (675) | (675) | (660) | (625) | (650) |
| °C. | 343 | 357 | 357 | 349 | 329 | 343 |
| VI of Lube | 105 | 109 | 112 | 115 | 125 | 111 |

Table I data show that the VI of the lube fraction is a function of the initial boiling point of fraction isolated; the lower the initial boiling point, the lower the VI. Data in Table I show that when the initial boiling point is 650° F., lube VI is 105. Lubes with 675° F. boiling point produced VI in the range of 109–112. 0.46 wt.% water cofeed produced 625° F.+ lube with 125 VI. A lube fraction with 650° F. initial boiling point would have more than 125 VI. Cofeeding 1.9 wt.% water produced low lube yield with 660° F.+ VI of 115. Therefore, cofeeding 1.9 wt.% water produces less beneficial effect compared to 0.46 wt.% cofeed. Furthermore, example C indicates that in the absence of water cofeed, the lube fraction VI decreases by more than 14 numbers when compared with B.

EXAMPLE 2

70/1$SiO_2$/$Al_2O_3$ ZSM-5 is extruded with alumina (65% zeolite, 35% alumina binder, on a dry basis). Available properties of this catalyst are as follows: Alpha Value is an approximate indication of the catalytic cracking activity of the catalyst compared to a standard catalyst and it gives the relative rate constant (rate of normal hexane conversion per volume of catalyst per unit time). It is based on the activity of the highly active silica-alumina cracking catalyst taken as an Alpha of 1 (Rate Constant=0.016 $sec^{-1}$). The Alpha Test is described in U.S. Pat. No. 3,354,078 and in *The Journal of Catalysts,* Vol. IV, pp. 522–529 (August 1965), each incorporated herein as to that description. It is noted that intrinsic rate constants for many acid-catalyzed reactions are proportional to the Alpha Value for a particular crytalline silicate catalyst (see "The Active Site of Acidic Aluminosilicate Catalysts," *Nature,* Vol. 309, No. 5959, pp. 589–591, June 14, 1984).

| | |
|---|---|
| Na | 450 ppm |
| N | 4 ppm |
| Surface Area | 349 $m^2$/gm |
| Particle Density | 0.88 gm/cc |
| Pore Volume | 0.76 cc/gm |
| Crush Strength | 75 lb/linear inch |
| Hexane Cracking Activity (Alpha Value) | 230 |

15 parts by weight of the extrudate catalyst is mixed with 22 parts by weight purified sand and is placed in a closed pressure vessel as a fixed bed. A charge of propylene is continuously fed at a rate of 0.35 WHSV and water is supplied by simultaneously cofeeding a saturated nitrogen stream. Data are summarized in Table II.

TABLE II

Propylene Polymerization in Example 2

| | | | | | |
|---|---|---|---|---|---|
| Run No. | 17 | 19 | — | — | — |
| Time on Steam, Days | 23 | 30 | — | — | — |
| Temperature, | | | | | |
| (°F.) | (460) | (462) | (480) | (445) | (480) |
| °C. | 238 | 239 | 249 | 229 | 249 |
| Wt. % $H_2O$ | 0 | 0.69 | — | — | — |
| *2,6-DTBP/ppm | | | 102 | 189 | 416 |
| Pressure, (psig), kpa | (1000) | (1000) | (800) | (800) | (800) |

TABLE II-continued

Propylene Polymerization in Example 2

| | | | | | |
|---|---|---|---|---|---|
| | 6900 | 6900 | 5520 | 5520 | 5520 |
| WHSV | 0.33 | 0.35 | 0.19 | 0.19 | 0.19 |
| % 650° F.+ (343° C.) in Liquid | 24 | 23 | 20 | 21.6 | 24.1 |
| Initial Boiling Point of | (675) | (675) | (650) | (650) | (650) |
| Lube Isolated, (°F.) °C. | 357 | 357 | 343 | 343 | 343 |
| VI of Lube | 90 | 109 | 107 | 124 | 112 |

*2,6-Ditertiarybutylpyridine, ppm based on catalyst

Analyzing the results summarized in Table II it is evident that cofeeding small amounts of water increases the lube fraction viscosity index by 19. High VI lubes are obtained using 2,6-ditertiarybutylpyridine (2,6-DTBP) surface modified catalyst as shown in Table II. The 650° F.+ lubes from 2,6-DTBP surface modified catalyst show VI's in the range of 107–124. Therefore, the water cofeed beneficial effect is comparable to surface modified catalyst using 2,6-DTBP as disclosed in U.S. Pat. No. 4,568,786 to Chen.

EXAMPLE 3

The standard ZSM-5 catalyst of Example 1 is extruded with 35% silica. Acid activity (alpha value) of this catalyst is 170. As in the previous examples 15 parts by weight extrudate catalyst is mixed with 22 parts by weight purified sand, placed in a closed pressure vessel reactor as a fixed bed and a charge of propylene is continuously fed at 0.3–0.8 WHSV and system pressure of kpa 2760–12765 (400–1850 psig). A summary of the results appears in Table III.

The data in runs 4, 7 and 18 indicate that the VI of the lube fraction is a function of initial boiling point, the lower the initial boiling point of the lube fraction isolated the lower the VI. Therefore, lube fractions with the same initial boiling points can be compared directly. The data in Table III indicate that the simultaneous cofeeding of water and propylene increased the VI. For 0.61 wt.% $H_2O$ cofeed the increase is 17 VI (7, 23). Furthermore, the data indicate that 0.61 wt.% water is more effective than 0.36 wt.% (runs 19 and 23). Similarly, 0.85 wt.% and 0.65 wt.% water cofeed produced the same beneficial effect (runs 26, 29), and this effect compare to run 4 is 26 VI numbers. As shown in run 31, 1.25 wt.% water cofeed is less effective than 0.85 wt.%. Therefore, high VI lubes can be obtained via a continuous process in a fixed bed reactor using ZSM-5-type catalysts by simply cofeeding small amounts of water simultaneously with the olefins feed.

While the invention has been set forth herein by specific examples, there is no intent to limit the inventive concept as set forth in the following claims.

TABLE III

Propylene Polymerization in Example 3

| | | | | | | | | |
|---|---|---|---|---|---|---|---|---|
| Run No. | 4 | 7 | 18 | 19 | 23 | 26 | 29 | 31 |
| Time on Stream, Days | 7 | 14 | 32 | 35 | 42 | 45 | 50 | 52 |
| Pressure, kpa, (psig) | (400) | (400) | (1050) | (1050) | (1050) | (1850) | (1850) | (1850) |
| | 2760 | 2760 | 7245 | 7245 | 7245 | 12765 | 12765 | 12765 |
| Temperature, (°F.) °C. | (442) | (450) | (480) | (480) | (480) | (480) | (480) | (480) |
| | 228 | 232 | 249 | 249 | 249 | 249 | 249 | 249 |
| Wt. %, Water | 0 | 0 | 0 | 0.36 | 0.61 | 0.65 | 0.85 | 1.25 |
| WHSV | 0.75 | 0.75 | 0.35 | 0.35 | 0.35 | 0.35 | 0.35 | 0.35 |
| Wt. %, 650° F. (342° C.) in Liquid | 22 | 18 | 22 | 21 | 19 | 17 | 16 | 15 |
| Initial Boiling Point | (625) | (650) | (680) | (650) | (650) | (630) | (625) | (620) |
| of Lube Isolated, (°F.) °C. | 329 | 343 | 360 | 343 | 343 | 332 | 329 | |
| VI of Lube | 74 | 85 | 91 | 94 | 102 | 100 | 100 | 94 |

What is claimed is:

1. A process for the production of high viscosity index lubricating oils comprising:

contacting at least one lower olefin feedstock with small crystal size medium pore metallosilicate solid acid catalyst having the crystalline structure of ZSM-5 at temperature between 150 degrees C. and 400 degrees C. and pressure of at least 1500 kPa in the presence of between 0.5 parts per million and 5 weight percent water based on olefin feedstock to produce a mixture comprising oligomerized lower olefin having a viscosity index greater than 85.

2. A process according to claim 1 wherein said oligomerizing temperature is about 260° C. and said oligomerizing pressure is about 2800 to 20,000 kpa.

3. A process according to claim 1 wherein said metallosilicate solid catalyst comprises ZSM-5 with a silica:alumina ratio of 12 or greater, a constraint index between 1 to 12 and a crystallite size of about 0.02 to 0.05 micron.

4. A process according to claim 1 wherein the oligomerized olefin is propylene.

5. In the process comprising contacting substantially lower olefinic hydrocarbons with a medium pore shape selective acid metallosilicate catalyst under polymerization conditions to produce a mixture comprising polymerized olefins and separating said mixture to produce a substantially $C_{20}+$ lubeoil fraction, the improvement comprising, polymerizing the lower olefinic hydrocarbons in the presence of between 50 ppm and 5 wt.% water based on the weight of olefinic hydrocarbons in contact with small crystal size acid metallosilicate catalyst to produce a lubeoil fraction with a viscosity index greater than 85.

6. A process according to claim 5 wherein said medium pore shape selective acid metallosilicate catalyst is ZSM-5 having a crystallite size between 0.02 and 0.05 micron.

7. A process according to claim 5 wherein said olefinic hydrocarbons are polymerized between a temperature of 150 degrees C. and 450 degrees C. and a pressure of at least 1500 KPa.

* * * * *

UNITED STATES PATENT AND TRADEMARK OFFICE

CERTIFICATE OF CORRECTION

PATENT NO. : 4,754,096

DATED : June 28, 1988

INVENTOR(S) : Chang et al.

It is certified that error appears in the above-identified patent and that said Letters Patent is hereby corrected as shown below:

Column 7, line 8, "0.5" should read --50--

Column 8, line 19, "450" should read --400--

Signed and Sealed this

First Day of December, 1992

*Attest:*

DOUGLAS B. COMER

*Attesting Officer*

*Acting Commissioner of Patents and Trademarks*